United States Patent [19]

Lipkin

[11] Patent Number: 4,608,721

[45] Date of Patent: Sep. 2, 1986

[54] BASEBALL CAP WITH ELASTIC HINGE

[75] Inventor: William S. Lipkin, Minneapolis, Minn.

[73] Assignee: M. U. Industries, Inc., Minneapolis, Minn.

[21] Appl. No.: 677,287

[22] Filed: Dec. 3, 1984

[51] Int. Cl.[4] ..... A42B 1/06

[52] U.S. Cl. ..... 2/172; 2/197

[58] Field of Search ..... 2/172, 195, 197, 200, 2/199, 181, 183, 208, 209

[56] References Cited

U.S. PATENT DOCUMENTS

| | | | |
|---|---|---|---|
| 705,068 | 7/1902 | Gordon | 2/172 |
| 1,207,420 | 12/1916 | Levinson | 2/172 |
| 1,350,869 | 8/1920 | Kornfeld | 2/172 |
| 1,540,405 | 6/1925 | Kromer | 2/172 |

FOREIGN PATENT DOCUMENTS

| | | | |
|---|---|---|---|
| 0959568 | 6/1964 | United Kingdom | 2/172 |

*Primary Examiner*—Peter Nerbun

*Attorney, Agent, or Firm*—Orrin M. Haugen; Thomas J. Nikolai; Frederick W. Niebuhr

[57] ABSTRACT

A cap structure suitable for multi-size utilization including a shell forming the crown portion fabricated from biaxially stretchable fabric, a visor portion secured to the forward edge of the shell, and an elongated band forming an ear flap portion hingedly secured to the base of the shell. The ear flap portion is adapted to be folded inwardly and upwardly in a first disposition, and downwardly about the ears of the wearer in an ear-enveloping disposition, with the ear flap portion being fabricated from a material which is stretchable at least along the axial length thereof. Hinge means are provided to secure the ear flap portion to the crown portion, and with the positioning of the stitches coupling the hinge means to the crown portion and to the ear flap portion being arranged so that the ear flap portion overlaps no more than one layer of the hinge means when the ear flap portion is folded inwardly and upwardly into the crown portion between the crown portion and the wearer's head.

3 Claims, 5 Drawing Figures

BASEBALL CAP WITH ELASTIC HINGE

BACKGROUND OF THE INVENTION

The present invention relates generally to an improved cap structure, and more particularly to an improved multi-size cap of the baseball cap configuration, and with one size being adapted to accommodate wearers with a variety of sizes of heads. The multi-size cap structure of the present invention is further provided with ear flaps which fold inwardly and upwardly of the crown portion of the cap when not in use, and with the arrangement providing for minimal overlapping of layers so as to enhance the comfort of the cap and avoid a tight-fitting structure with the ear flaps folded up, and further avoiding a loose-fitting cap when the ear flaps are folded downwardly to envelope the ears of the wearer. The structure of the present invention permits multi-size cap structures to be fabricated which are comfortable for the wearer, and with a single size of cap being adaptable for use by all persons with heads of normal size.

In the past, attempts have been made to provide multi-size cap structures of the baseball cap style, and such caps are in wide-spread use today. More recently, attempts have been made to provide caps of the baseball cap type or style, wherein ear flaps are provided to provide an added degree of comfort to the wearer during unseasonable weather, including cold weather with precipitation in the form of either rain or snow.

Multi-size caps of the baseball cap style are marketed in a variety of ways. These caps are marketed through conventional retail outlets, and have also found a substantial market as a promotional item. Various types of business entities will provide such promotional items to employees and/or customers, and in these instances, the outer surface of the crown at a point above the visor may carry an emblem, or other indicia identifying the business entity. Because of the manner in which these products are marketed, it is, of course, desirable to utilize the products with minimal size variation requirements, hence the multi-size caps become extremely desirable for the customer.

As is conventional, baseball caps employ a crown portion to which a visor is secured to the forward edge of the crown and extends outwardly therefrom. An elongated band forming an ear flap portion is hingedly secured to the base of the crown and is adapted to be upwardly and inwardly folded in one disposition, and is also adapted to be downwardly folded about the ears of the wearer in its ear-enveloping disposition. Hinge means secure the elongated ear flap portion to the crown portion along both of the lateral as well as the rear segments of the crown portion.

In order to provide gores to form the crown portion which are biaxially stretchable, a laminated cloth-foam resin structure is normally employed. Such laminated foam structures typically have a synthetic resin foam interposed or sandwiched between outer cloth or fabric layers. The weave of the fabric layers is such that the cloth is biaxially stretchable. Such a material is utilized in the multi-size cap structures of the present invention, and thereby assist in achieving an accommodation of wearers with heads of various sizes. For purposes of achieving substantially universal utilization with a single size cap structure, the material forming the crown portion is selected so that it is capable of a 20 percent stretch in each axial direction. Such materials are, of course, commercially available. For those instances when more than one size cap structure will be employed to accommodate all wearers, a biaxial stretch of up to about 10 percent is normally found to be satisfactory.

As indicated, the forward portion of the cap will normally be provided with a visor or bill, with the visor normally being positioned above the eyes and forehead of the wearer. Since the visor material is normally non-stretchable or non-elastic, means must be provided to achieve sufficient stretch or elasticity in the remaining edges of the crown portion of the cap. These remaining portions are, as above indicated, the lateral side portions and the rear portion. Even considering the requirement of the presence of the visor or bill, along with the constraint on the number of sizes to be stocked so as to accommodate wearers with heads of normal sizes, the cap structure of the present invention has been found to accommodate these desirable features and provide a means for manufacturing a cap for unseasonable or winter weather wherein a single cap structure capable of multi-size accommodation may be employed.

When an individual wears a multi-size cap, particularly one with inwardly and upwardly folded ear flaps, caps of conventional design are somewhat uncomfortable to wear. Specifically, when the layers are superimposed, one upon the other, most of the stress created in the stretch or expansion of the cap structure occurs at or along a line which is adjacent the lower edge of the crown. Such a condition creates a degree of discomfort to the wearer, since the tension created within the fabric is concentrated along a line around the user's skull. This discomfort is alleviated with the design of the present structure, since the ear flaps are hingedly secured with an elastic hinge member to the base of the crown, and the design is such that the ear flap portion overlaps no more than one layer of hinge when the ear flap portion is in its inwardly folded position. Also, when the ear flap is extended downwardly so as to cover the ears of the wearer, the elastic hinge member permits relative movement between the crown portion and the ear flap portion, thereby achieving an added degree of comfort.

SUMMARY OF THE INVENTION

Therefore, it is a primary object of the present invention to provide an improved baseball-type cap device employing ear flaps for winter-time use, and wherein the entire structure may be fabricated from stretchable fabric, including stretchable laminated foam fabrics.

It is a further object of the present invention to provide a baseball-type cap structure capable of multi-size use, which can be manufactured utilizing conventional materials and fabrics, and which is both functional and attractive in its use and appearance.

It is yet a further object of the present invention to provide an improved multi-size cap structure of the baseball-cap style, which employs inwardly folding ear flaps to accommodate winter-time use, and wherein the structure is arranged so as to avoid the presence or occurrence of a large number of fabric layers in superposed relationship, thereby enhancing the comfort of the cap while being worn.

Other and further objects of the present invention will become apparent to those skilled in the art upon a study of the following specification, appended claims and accompanying drawing.

IN THE DRAWING

FIG. 1 is a side elevational view of a baseball-type cap made in accordance with the present invention, and illustrating the manner in which the ear flap portion shown in lowered disposition is coupled to the crown portion, and further illustrating, in cut-away form, the detailed manner in which the ear flap portion is secured to the edge of the crown portion;

FIG. 2 is a vertical sectional view taken along the line and in the direction of the arrows 2—2 of FIG. 1, and illustrating the details of the foam-fabric laminate structure from which the stretchable fabric is made, and further illustrating the manner in which the hinge means couples together the edge of the crown portion and the ear flap portion, with FIG. 2 showing the ear flap portions in its downwardly extended disposition;

DESCRIPTION OF THE PREFERRED EMBODIMENT

Figure 1:
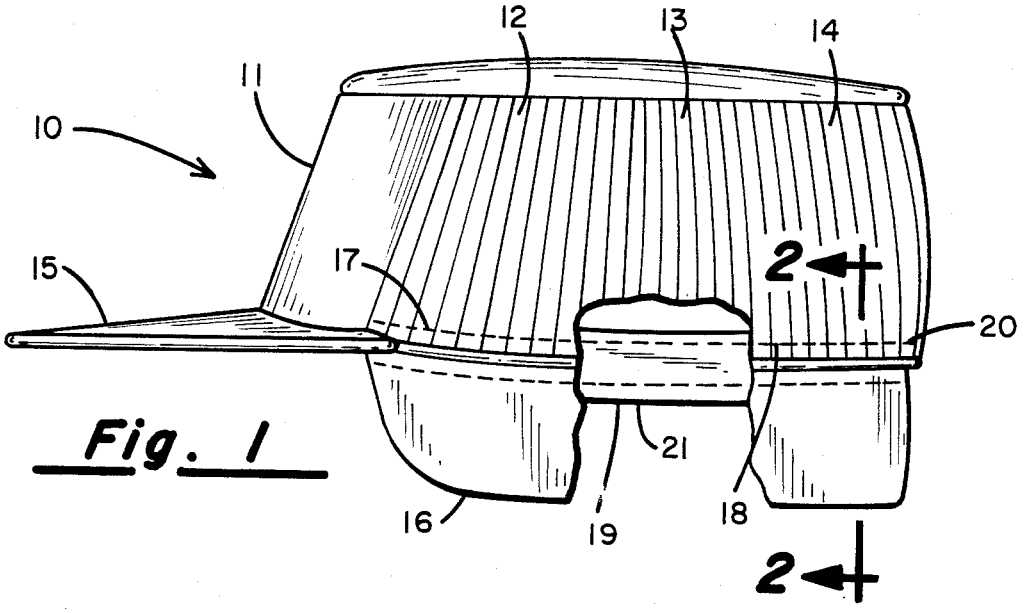

In accordance with the preferred embodiment of the present invention, and with particular attention directed to FIG. 1, the multi-size cap structure generally designated 10 includes a multi-gore shell 11 formed of individual gores such as gores 12, 13, and 14, forming the crown portion. A visor or bill portion 15 is secured to the forward edge of the shell and extends outwardly therefrom. The visor, as previously indicated, is normally somewhat rigid, and hence is not stretchable in the manner in which the crown portion is stretchable. An elongated band forming an ear flap portion 16 is hingedly secured to the base of the shell as at 17, about the lateral and rear portions 18, 19, and 20 respectively of the shell 11. The hinge member 21 functions as the inter-coupling member. The ear flap portion is adapted to be folded inwardly and upwardly of the shell to assume an inwardly folded first disposition. Alternatively, the ear flap portion may be folded downwardly about the ears of the wearer in an ear-enveloping disposition. The hinge means securing the ear flap portion to the crown portion is, of course, sufficiently flexible so as to accommodate the folding of the flaps.

The multi-gore shell 11 is fabricated from biaxially stretchable fabric, such as the laminated fabric comprising a sandwich assembly of a synthetic resin foam interposed between two layers of stretchable fabric. The entire arrangement is, of course, capable of being stretched along both lateral and longitudinal axes. Laminated fabric of the type described above and having a capability of biaxial stretching up to about 20% of its relaxed dimension are, of course, commercially available.

The elongated band 16 forming the ear flap portion is stretchable along at least the longitudinal axis thereof. In certain instances, it is desirable to utilize the same material for the ear flap portion as the crown portion, it being understood, of course, that stability and comfort may be enhanced by utilizing a material which is stretchable at least along the longitudinal axis thereof, and to substantially the same extent as the crown portion. The ear flap portion is arranged to become elongated upon stretching of the crown portion and ear flap portion, in order to accommodate the circumferential dimension of the wearer's head. Stretch fabrics having a stretch capability of 20% in the longitudinal direction are, of course, commercially available.

Figure 2:
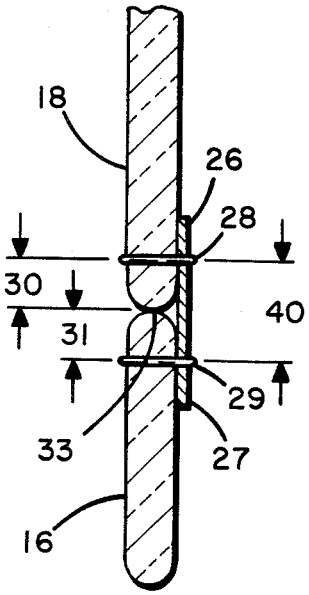
Figure 4:
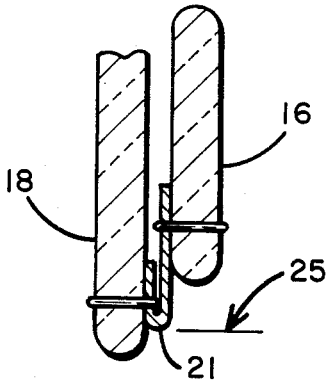
FIG. 4 is a sectional view similar to FIG. 2, but illustrating the ear flaps in their upwardly disposed configuration.

The hinge means 21 comprises a panel of fabric which is stretchable along the longitudinal axis. With attention being directed to FIG. 2 of the drawing, it will be observed that the hinge has an axis as at 25, with first and second laterally disposed side portions 26 and 27 on opposite sides thereof. As indicated, the hinge means is stretchable at least along its longitudinal axis. The hinge means is secured to the crown portion along stitch line 28, and is secured to the ear flap portion along stitch line 29. In the view shown in FIG. 2, the spacing 30 between the stitch line 28 and the crown edge exceeds the spacing between stitch line 28 and axis 25 by a certain predetermined dimension. The spacing 31 between the stitch line 29 securing the hinge to the ear flap portion and the axis exceeds the spacing between line 29 and the upper edge of flap portion 16. As is apparent in FIG. 2, the rounded edges of the crown portion and the ear flap portion are in substantial abutment as indicated, and define a junction line 33 generally coincident with the axis of the hinge means. The arithmetic sum of the distance from the axis of the first stitch line, and the distance from the axis to the second stitch line is determined, and is illustrated by the bracket as at 40. This arithmetic sum is greater than the arithmetic difference between the width dimension of the first laterally disposed side portion less the distance between the first stitch line and the hinge axis. The ear flap portion overlaps no more than one layer of the hinge means when the ear flap portion is in its inwardly folded disposition. This is because the distance between axis 25 and the uppermost plane of nominal thickness in flap portion 16 (i.e., at the beginning of its rounded edge) is greater than the width of side portion 26. The results of this functional description are illustrated in FIG. 4, where the hinge member is folded upon itself so as to accommodate inward folding of the ear flap portion.

Figure 5:
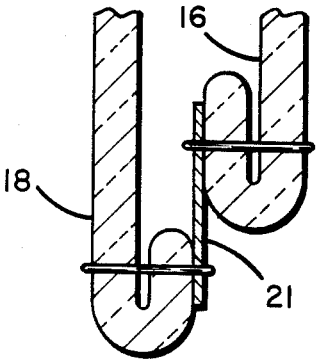
FIG. 5 is a sectional view similar to the view shown in FIG. 4, but illustrating an alternative embodiment of the present invention.
Figure 3:
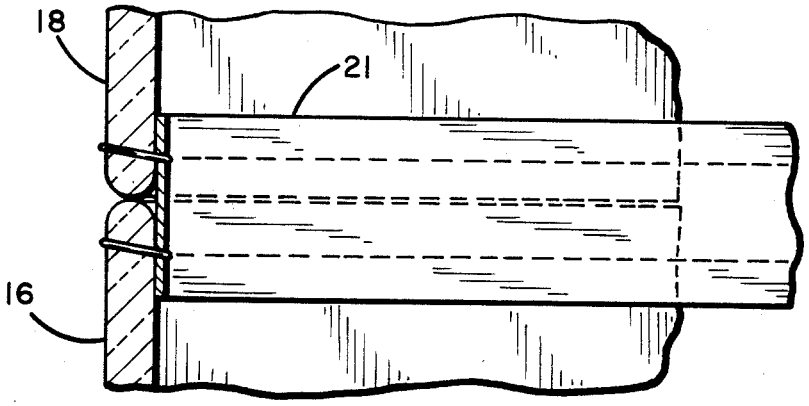
FIG. 3 is a vertical sectional view similar to FIG. 2, and illustrating the manner in which the fabric stretch occurs along one axial disposition, and further illustrating the manner in which differential stretching between the crown portion and the ear flap portion may be accommodated by virtue of the utilization of the elastic hinge portion.

Attention is now directed to FIG. 5 which illustrates the manner in which folds are created in an alternate embodiment of the present invention. Specifically, the arrangement is such that upon folding the ear flap portion inwardly, the fold line which is created avoids the gathering together of multiple layers, thereby permitting the smooth inwardly directed folding without unduly multiplying or overlapping of portions of the structure so as to create a thickened zone or portion.

As indicated, the structure of the present invention provides the advantage of arranging a minimal number of layers in superposed relationship, one upon the other, so that tensile stresses are not concentrated along a narrow band or line along the skull of the wearer. Furthermore, the wearer may utilize inwardly folded ear flaps which are desirable for use by those persons who may undergo a change in weather conditions which make it desirable for the ear flaps to be lowered.

It will be appreciated that various modifications of the present invention may be undertaken by those skilled in the art without departing from the spirit and scope hereof.

I claim:

1. In a multi-size cap structure adapted to accommodate wearers of various sizes of heads and including a multi-gore shell forming the crown portion, a visor portion secured to the forward edge of said shell and extending outwardly therefrom, an elongated band forming an ear flap portion hingedly secured to the base of said shell about the lateral and rear portions thereof, and adapted to be folded inwardly and upwardly in an upwardly folded first disposition, and downwardly about the ears of the wearer in an ear-enveloping disposition, and hinge means securing said elongated band to said crown portion along the length thereof, the improvement comprising:

(a) said multi-gore shell forming the crown portion being fabricated from a biaxially stretchable fabric and capable of being stretched along the longitudinal and lateral axes thereof;

(b) said elongated band forming said ear flap portion being stretchable along at least the longitudinal axis thereof and adapted to elongate upon stretching of the crown portion to accommodate the head of the wearer;

(c) said hinge means comprising a panel of fabric having a generally central longitudianl axis and first and second laterally disposed side portions on opposite sides thereof, said hinge panel fabric being stretchable at least along the longitudinal axis thereof and having said first and second lateral side portions secured to said crown portion and ear flap portion respectively at first and second stitch lines spaced at predetermined distances from the lateral edges of said crown portion and ear flap portion respectively;

(d) said crown portion and said ear flap portion being in substantial abutment along their lateral edges said lateral edges having a thickness less than the nominal thickness of the crown portion and flap portion, respectively, and defining a juncture line generally coincident with the axis of said hinge means; and (e) the distance between said longitudinal axis of the hinge means and the uppermost plane of nominal thickness in said flap portion being greater than the width of said first laterally disposed side portion so that the ear flap portion, at all of its points of nominal flap portion thickness, overlaps no more than one layer of hinge means when said ear flap portion is in said inwardly folded disposition.

2. The structure as defined in claim 1 being particularly characterized in that the gores forming said crown portion are fabricated from a laminate of synthetic resinous foam having a layer of fabric bonded to opposed surfaces thereof.

3. The structure as defined in claim 1 being particularly characterized in that said hinge means is stretchable only along the longitudinal axis.

* * * * *

UNITED STATES PATENT AND TRADEMARK OFFICE

CERTIFICATE OF CORRECTION

PATENT NO. : 4,608,721

DATED : September 2, 1986

INVENTOR(S) : William S. Lipkin

It is certified that error appears in the above-identified patent and that said Letters Patent are hereby corrected as shown below:

Column 5, Line 12, "upwardly" should read -- inwardly --.

Column 5, Line 27, "longitudianl" should read -- longitudinal --.

Column 6, Line 10, "the" should read -- said --.

Signed and Sealed this

Fourth Day of November, 1986

[SEAL]

*Attest:*

DONALD J. QUIGG

*Attesting Officer*

*Commissioner of Patents and Trademarks*